United States Patent [19]

Uyeda

[11] 4,312,199

[45] Jan. 26, 1982

[54] COMBINATION LOCK TUMBLER WHEEL CONSTRUCTION

[75] Inventor: Tim M. Uyeda, South San Gabriel, Calif.

[73] Assignee: La Gard Lock, Inc., Torrance, Calif.

[21] Appl. No.: 152,195

[22] Filed: May 22, 1980

[51] Int. Cl.[3] ..... E05B 37/00

[52] U.S. Cl. ..... 70/316; 70/323

[58] Field of Search ..... 70/315, 316, 317, 318, 70/323

[56] References Cited

U.S. PATENT DOCUMENTS

| | | | |
|---|---|---|---|
| 8,593 | 12/1951 | Rickard et al. . | |
| 83,129 | 10/1908 | Brettell . | |
| 370,568 | 9/1887 | Stoner . | |
| 1,145,377 | 7/1950 | Lewis . | |
| 1,193,754 | 8/1916 | Benham . | |
| 1,240,114 | 9/1917 | Baum . | |
| 1,484,692 | 2/1924 | Weber . | |
| 1,644,650 | 10/1927 | Millice . | |
| 1,956,069 | 9/1932 | Hill . | |
| 1,956,304 | 10/1930 | Abbott . | |
| 2,494,575 | 1/1950 | O'Brien . | |
| 3,254,519 | 6/1966 | Paul | 70/323 |
| 3,373,583 | 3/1968 | Parrock . | |
| 3,386,275 | 6/1968 | Potzick . | |
| 3,627,938 | 1/1966 | Davidson . | |
| 4,142,388 | 3/1979 | Phillips | 70/316 |

FOREIGN PATENT DOCUMENTS 1135180 of 0000 United Kingdom .

*Primary Examiner*—Robert L. Wolfe

*Attorney, Agent, or Firm*—Poms, Smith, Lande & Rose

[57] ABSTRACT

A gate ring for a combination lock tumbler that has securing means on the gate ring that normally prevents rotation of the gate ring with respect to the drive member. The securing means includes a cam that alternatively releases the securing means to permit rotation of the gate ring with respect to the drive means or returns the securing means to the normal position. The securing means also comprise a flexible web on the gate ring extending adjacent the outside of the drive member. The cam is mounted between the web and a portion of the gate ring. Rotation of the cam to its normal position moves the flexible web to its normal position against the drive member, and rotation of the cam to its releasing position allows the web to move to its releasing position away from the drive member. The web is integrally formed on the gate ring, which is preferably plastic. The web is located along a chord of the circular gate ring perpendicular to a radius extending from the center of the gate ring through to the cam. The cam may have shoulders that go over a portion of the gate ring and the web to hold the cam in place. The web is mounted such that it is elastically stretched by the cam to its normal position whereby the web is urged against the cam to limit movement of the cam, and the elasticity of the web urges it to the releasing position when the cam is not urging the web to its normal position. Both the web and the drive member have gripping means for securing the drive member to the web and gate ring.

5 Claims, 8 Drawing Figures

COMBINATION LOCK TUMBLER WHEEL CONSTRUCTION

BACKGROUND OF THE INVENTION

This invention generally relates to combination lock systems and to the construction of tumbler wheels in combination locks that are designed to permit changing combination of such locks.

Similar to many prior art combination locks, the tumbler wheels have gates in the outside edge of the wheels. Because of the relationship between adjacent tumbler wheels, as the combination lock is turned in one direction and then the other, one or more of the wheels are rotated until all of the gates are aligned, and an arm can fit into the gates. This either permits the bolt to be released or the arm may contact a pawl which opens the bolt upon further rotation of the dial.

The combination of such locks can be adjusted by having a two-piece tumbler wheel with a drive ring or member and a gate ring mounted concentrically around the drive member. The drive member fixed to the dial, and the gate ring is normally locked in place on the drive member so that they rotate together. Upon release of a cam or other member the gate ring can rotate around the drive member so that the position of the gate can be altered with respect to the position of the dial. U.S. Pat. No. 4,142,388 (1979) to Peter Phillips as well as some of the prior art cited therein have adjustable gate rings.

In the past, although plastic has been suggested because the tumbler wheel does not carry large loads, the tumbler wheels have generally been constructed of metal. Machining of metal is costly, however, and it is also heavier so that it has greater inertia requiring more force to start and stop rotation. Another problem with metal tumbler wheels is that they can be observed through x-rays. As thieves and other unauthorized persons become more sophisticated, some have resorted to using x-rays to determine the position of the tumbler wheels. Plastic is generally transparent to x-rays so that it cannot be observed. Also unlike plastic, some metals are also magnetic, and thieves may magnetically manipulate some tumblers.

Therefore, it is an object of the present invention to disclose and provide a tumbler wheel construction in which the gate ring is formed of plastic. Another object of the present invention is to disclose and provide a tumbler wheel that is easily manufactured. In many of the prior art devices, the mechanism for releasing the gate member from the drive means was exceedily complex and required assembling many subparts. Injenction molded plastic meets these criteria.

In the aforementioned Phillips patent, the gate ring is secured to the drive member by means of an integral arm which is normally resiliently biased to the securing position. A key or cam can urge the leg out of engagement with the drive member, but other than the leg's resiliency, nothing other than removing the key or cam is necessary to secure the leg to the drive member. Resiliency is thus important, but need not be used only to urge a leg against the drive member only to be overcome by a cam; the resiliency could also urge a leg away from the drive member and the cam could overcome this resiliency positioning the leg against the drive member. Without resiliency the leg would have to be moved by a cam or other mechanical device both against the drive member and away from it. In a small diameter, thin gate ring made of plastic, it would be difficult to provide sufficient biasing with a single leg construction. Therefore, one of the objects of the present invention is to disclose and provide a construction for the gate ring with sufficient resiliency.

Another problem in the prior art, albeit minor, has been in determining whether the gate ring is locked with respect to the drive member. This is sometimes difficult to do visually assuming that the tumbler wheels are visible. It is an object, therefore, of the present invention to disclose and provide indicia that will permit visual inspection to determine whether the gate ring is locked to the drive member.

These objects are met by the present invention, which also meets other objects that, although not set forth specifically herein, are evident from the description of the invention.

SUMMARY OF THE INVENTION

A gate ring for a combination lock tumbler has a central opening for receiving a drive member therein. The drive member and gate ring normally rotate together for positioning the gate of the gate ring to different orientations so that in one orientation, a latch can move into the gate for unlocking the lock. Securing means on the gate ring normally prevents rotation of the gate ring with respect to the drive member. The securing means includes a cam for alternatively releasing the securing means to permit rotation of the gate ring with respect to the drive means or returning the securing means to the normal position. The gate ring has been improved by having the securing means comprise a flexible web on the gate ring extending adjacent the outside of the drive member. The cam is mounted between the web and a portion of the gate ring such that rotation of the cam to its normal position moves the flexible web to its normal position against the drive member, and rotation of the cam to its releasing position allows the web to move to its releasing position away from the drive member. The gate ring is formed of plastic, and the web is integrally formed on the gate ring. The web is located along a chord of the circular gate ring. The cam may have shoulder over a portion of the gate ring and the web to hold the cam in place. The chord is perpendicular to a radius extending from the center of the gate ring through to the cam. The web is mounted such that it is elastically stretched by the cam to its normal position whereby the web is urged against the cam to limit movement of the cam, and the elasticity of the web urges it to the releasing position when the cam is not urging the web to its normal position. Both the web and the drive member have gripping means for securing the drive member to the web and gate ring.

BRIEF DESCRIPTION OF THE DRAWINGS

On the first sheet,

On the second sheet.

In FIG. 6, the web is in contact with the drive member, and in FIG. 7, after turning the cam, the web is retracted from the drive member.

DETAILED DESCRIPTION OF THE PREFERRED EMBODIMENT

Figure 1:
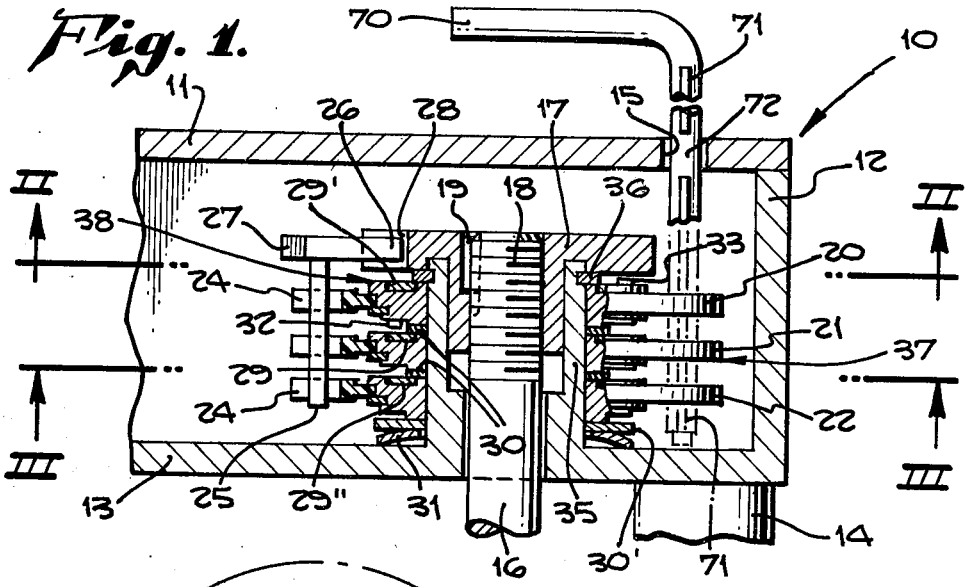
FIG. 1 is a plan view in section of a combination lock system using the gate ring and drive member tumbler wheel combination construction of the present invention.

The Combination Lock. The tumbler wheel of the present invention is used in a combination lock. The preferred exemplary embodiment of the entire lock is shown in FIG. 1, primarily. It includes a case 10 having rear cover 11, sidewall 12 and front wall 13. Another sidewall on the left side of FIG. 1 would also be provided but it is not shown in the drawings. It is through this wall that locking bolt (not shown) typically passes. Case 10 also has top and bottom walls, which are also not shown. Spacer 14 is provided for mounting the case to the safe door although the case could be mounted directly to the door, or the door could comprise the front wall 13. Bore 15 is provided through the rear wall 11 for insertion of the key for changing the combination of the lock. A dial (not shown) is fixed to shaft 16 on the outside of the safe. The other end of shaft 16 is threaded along threads 18 and keyed at 19 to driver 17 to prevent relative rotation between the shaft and the drive. Rotation of driver 17 rotates the tumblers. In the exemplary embodiment, three tumblers are shown, rear tumbler 20, central tumbler 21 and forward tumbler 22, and they rotate around journal member 35 in which cam 17 also rotates.

Figure 2:
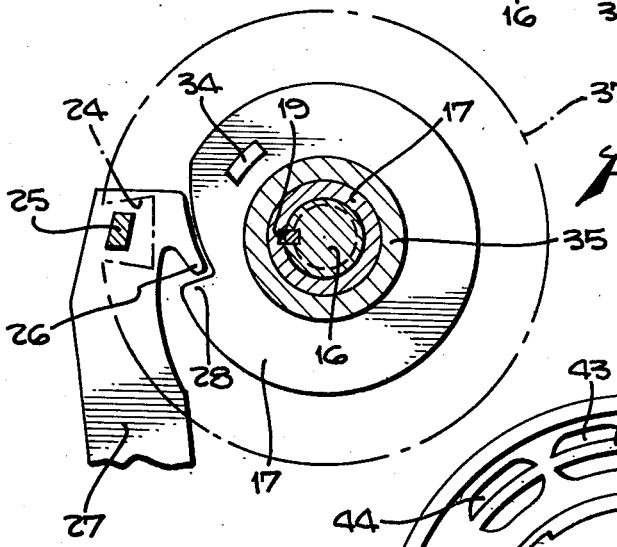
FIG. 2 is a sectional view taken through plane II—II in FIG. 1 and shows the detail in the cooperation between the latch arm and the opening pawl.
Figure 3:
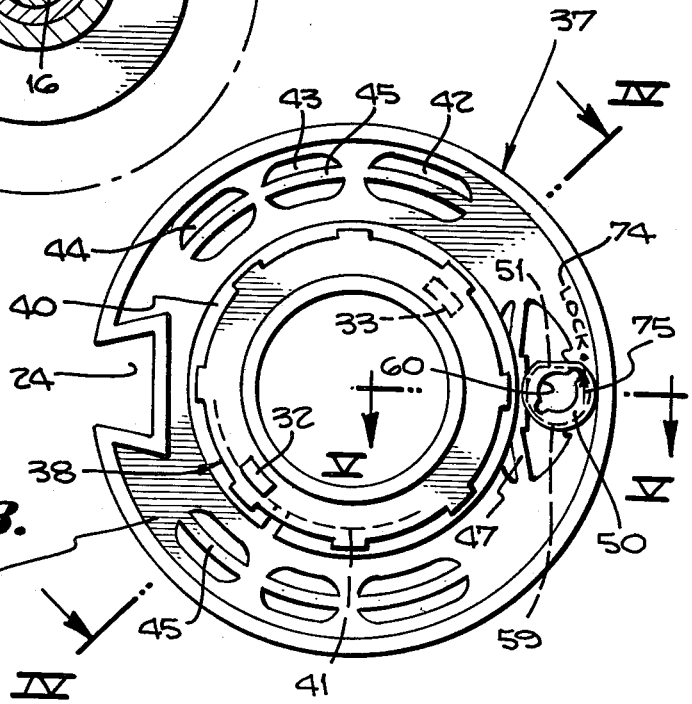
FIG. 3 is a sectional view through plane III—III in FIG. 1 and shows the detail of the tumbler wheel construction including the gate ring and the drive member.

Each of the tumblers is essentially identical. For illustration, FIG. 3 shows central wheel 21. Dialing the proper combination aligns all of the gates, such as gate 24 with fence 25 (FIGS. 1 and 2). As shown primarily in FIG. 2, when fence 25 moves into the gate, hook 26 on lever arm 27 engages pawl 28 on cam 17. Continued rotation of the driver pulls latch arm to the right (FIG. 1), and through its connection with the bolt (not shown) unlocks the lock.

As shown in FIG. 1, the tumbler wheels 20, 21 and 22 are mounted on journal member 35 and separated by washers 30. A retaining ring 36 is provided between driver 17 and rear tumbler 20, and that ring in combination with forward washers 30', space washers 30 and spring washer 31 (FIG. 1) hold the tumbler wheels in their proper axial alignment.

In order to rotate the tumblers, each is provided with a projection 32 and a fly 29, the latter being moveable in a small arc and having a projection 33 thereon. Cam 17 also has a projection 34 (FIG. 2). Rotation of cam 17 eventually will cause projection 34 to contact projection 33 on fly 29' which in turn will rotate tumbler wheel 20, and rotation of tumbler wheel will cause projection 32 to engage a rear fly 29 through projection 33 of tumbler wheel 21. Rotating the driver in the opposite direction stops the rear tumbler wheel, but it is reengaged when the driver completes a full revolution in the opposite direction. Thus, the tumblers eventually reach their desired position. In order to change the combination of the lock, the position of the dial must be changed with respect to gates 24. Each tumbler wheel must be in two pieces plus the fly as discussed below.

Figure 4:
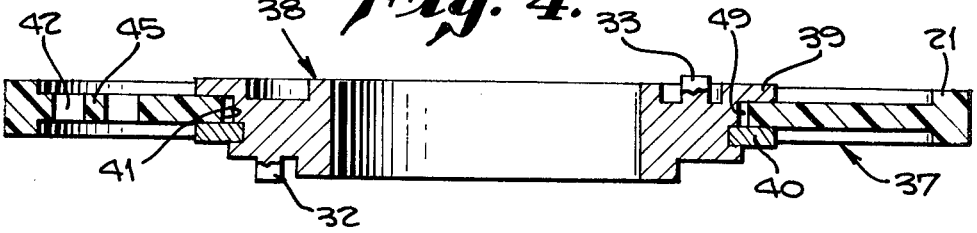
FIG. 4 is a sectional view of the tumbler wheel of the present invention through plane IV—IV of FIG. 3.
Figure 8:
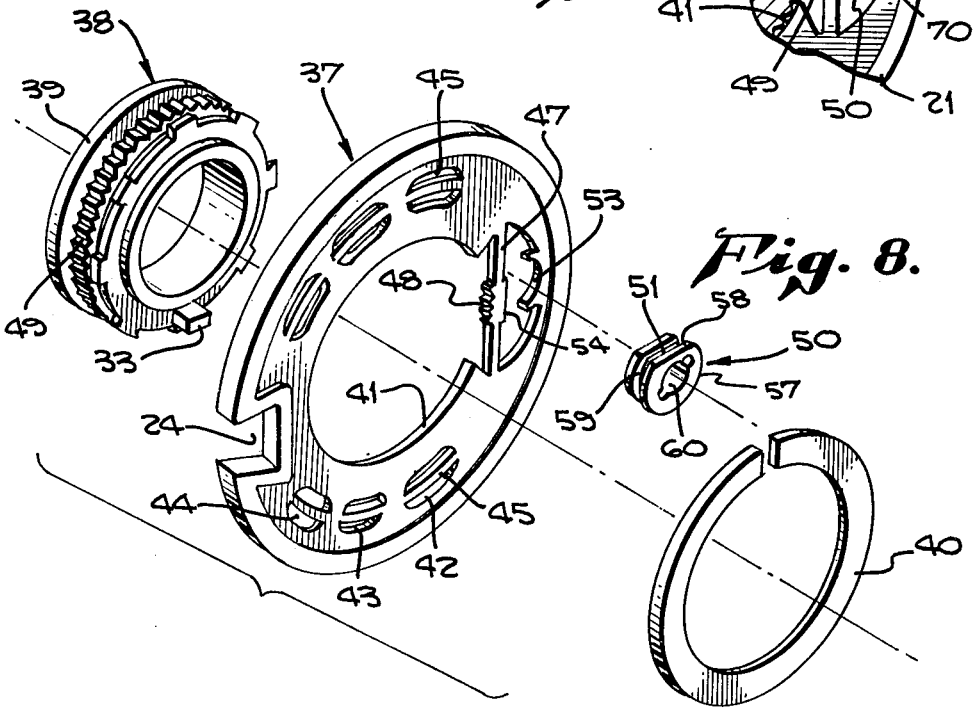
FIG. 8 is an exploded view of the tumbler wheel of the present invention.

The Tumbler Wheels. To provide adjustability of the gates with respect to the dial and its shaft 16, each tumbler wheel is formed of two pieces, a gate ring and a drive member in the central opening of the gate ring. In the exemplary embodiment, especially FIGS. 3, 4 and 8, tumbler wheel 21 includes gate ring 37 and drive member 38. As shown primarily in FIG. 8, drive member 38 is held in central opening 41 on the gate ring by rim 39 on the drive member and by snap ring 40. The fit between drive member 38 and gate ring 37 is somewhat loose (FIG. 4), which permits rotation of the two with respect to each other.

Drive member 38 may be formed of different materials such as plastic or metal. If formed out of metal, brass or similar alloys, which are nonmagnetic and noncorrosive, are preferable to steel. Snap ring 40 may also be of metal or plastic.

The gate ring is preferably formed of plastic for low cost and so that the position of gates 24 cannot be determined through x-ray analysis and so that the gates cannot be detected or manipulated magnetically. The gate ring 37 has a plurality of openings 42, 43 and 44 (FIGS. 3 and 8) with a rib 45 running through all of them. The openings allow less material to be used and decreases the weight, and the rib 45 provides additional strength. Gate 25 is an indentation on one side of the gate ring.

Figure 5:
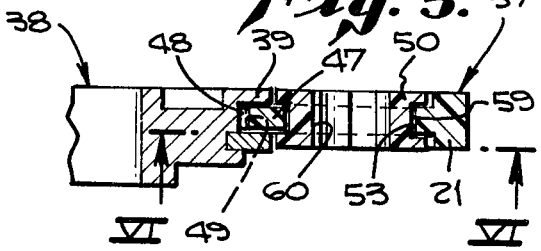
FIG. 5 is a sectional view taken through plane V—V in FIG. 3 and shows in greater detail the gate ring and cam.

As previously stated, the gate ring 21 can be rotated with respect to the drive member 38. Securing means on the gate ring normally prevent rotation of the gate ring with respect to the drive member. The securing means includes a cam 50 which alternatively releases the securing means to permit rotation of the gate ring with respect to the drive member or allows returning of the securing means to the normal position. The securing means further includes a flexible web on the gate ring extending adjacent the outside of the drive member. In the exemplary embodiment, web 47 is most clearly shown in FIGS. 3, 6, 7 and 8. Web 47 on gate ring 37 adjacent drive member 38 has means for receiving cam 50 between the flexible web and a portion of the gate ring. In the preferred exemplary embodiment, particularly FIGS. 3, 6, 7 and 8, the means for receiving the cam include a circular portion 53 opposite web 47. The web may also have a built-up portion 54. As best shown in the sectional view of FIG. 5, cam 50 has a cam surface 59 of a thickness approximately equal to the thickness of the web 47 and of the portion 53 of the gate ring adjacent the cam. The cam has shoulders 57 and 58 which engage the web and the portion of the gate ring adjacent the cam to prevent axial movement of the cam (up-down movement in FIG. 5 or in-out movement in FIG. 3). Cam surface 59 is generally circular along a portion 52 of the cam but has a flat area 51.

Figure 6:
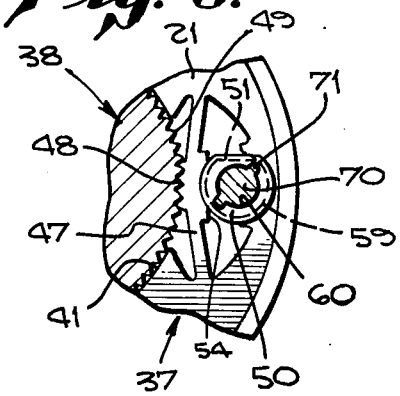
FIGS. 6 and 7 are partially sectioned side views of the cam, flexible web, and gate ring arrangement in the tumbler wheel of the present invention.
Figure 7:
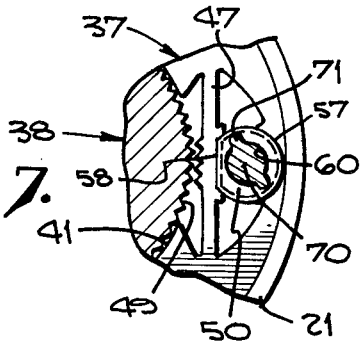

The normal cam-web position is shown in FIG. 6. When cam 50 is rotated by means of key 70 to the position in FIG. 7, the web 47, which is integrally formed on the plastic gate ring and which is flexible, tends to straighten out, assuming the FIG. 7 orientation and moving the web out of contact with drive member 38. For increased gripping, both the web 47 and drive member 38 are provided with opposing teeth 48 and 49 respectively, and in the releasing position, the teeth are not engaged. Rotating cam 50 to its normal position (FIG. 6) urges web 47 and teeth 48 against drive member 38 and teeth 49 against the resiliency of the plastic web. In this normal position, the gate ring 37 is fixed and cannot rotate on the drive member 38.

Web 47 is located along a chord of the gate ring and that chord is perpendicular to a radius extending from the center of the gate ring through the cam. Therefore, the cam urges the web to exert a radial force on the drive member thus maximizing the force between the web and gate ring on the drive member. Because the web is integrally formed on the plastic gate ring, it can be elastically stretched by the cam to its normal position (FIG. 6), but the elasticity will return web 47 to its FIG. 7 position upon rotating the cam 50 to its release position. This elasticity overcomes a potential problem of having to have the cam remove a gripper from against a drive member.

As shown primarily in FIG. 1, key 70 is inserted through opening 15 in rear wall 11 of case 10 such that it can pass through opening 60 on each of the cams 50. Opening 60 may be any shape but circular. The shape of the key 70 corresponds to the shape of the opening 60. In the exemplary embodiment, key 70 is generally circular with ridges 71 projecting therefrom. There is a space 72 that has no ridges, and that space is located in the opening 15 in rear wall 11 when the key is completely inserted. It is only in this position that the key can be rotated. Ridges 71 contact rear wall 11 adjacent opening 15 to prevent the key from being removed when the key is in any position other than the preferred normal position of the cams, for example that position shown in FIG. 6. The design prevents removal of the key 70 when the cam is in the releasing position (FIG. 7) for that would allow slippage of one or more gate rings with respect to their drive members.

During the assembly operation, it may be important to correctly position the cam 50 in its correct normal position, that is with circular face 52 adjacent web 47 and correctly aligned to receive key 70. Therefore, the cam and gate ring are provided with indicia such that by observing the position of the indicia relative to each other it can be determined whether the cam is in its normal position. In the exemplary embodiment, one indicia 74 includes the word "lock" and the other indicia 75 is an arrow on the cam. An operator merely has to position indicia 75 adjacent the "lock" and the cam will be in its normal position. This decreases the possibility of human error in assembly.

An exemplary embodiment could be constructed with various modifications to the configuration described above which would still come within the spirit of the invention. Changes that come within the scope of the claims are, therefore, embraced thereby.

I claim:

1. A gate ring for a combination lock tumbler wheel, the gate ring having a central opening for receiving therein a drive member normally rotating with the gate ring to move a gate on the gate ring to different orientations whereby at one orientation a latch can move into the gate for unlocking the lock, securing means on the gate ring for normally preventing rotation of the gate ring with respect to the drive member and including a cam for alternatively releasing the securing means to permit rotation of the gate ring with respect to the drive member or returning the securing means to the normal position, the improvement in securing means comprising:

a flexible web on the gate ring extending adjacent the outside of the drive member, the flexible web having means for receiving the cam between the flexible web and a portion of the gate ring, whereby rotation of the cam to its normal position moves the flexible web to its normal position against the drive member and whereby rotation of the cam to its releasing position allows the web to move to its releasing position away from the drive member and where the gate ring is formed of plastic, the web in integrally formed on the gate ring, the web is located along a chord of the gate ring and the cam is located between the web and the outside edge of the gate ring.

2. The improvement of claim 1 wherein the cam has a cam surface of a thickness approximately equal to the thickness of the web and of the portion of the gate ring adjacent the cam, the cam having shoulders for engaging the web and the portion of the gate ring adjacent the cam to prevent axial movement of the cam.

3. The improvement of claim 1 wherein the chord is perpendicular to a radius extending from the center of the gate ring through the cam.

4. A gate ring for a combination lock tumbler wheel, the gate ring having a central opening for receiving therein a drive member normally rotating with the gate ring to move a gate on the gate ring to different orientations whereby at one orientation a latch can move into the gate for unlocking the lock, securing means on the gate ring for normally preventing rotation of the gate ring with respect to the drive member and including a cam for alternatively releasing the securing means to permit rotation of the gatering with respect to the drive member or returning the securing means to the normal position, the improvement in securing means comprising:

a flexible web on the gate ring extending adjacent the outside of the drive member, the flexible web having means for receiving the cam between the flexible web and a portion of the gate ring, whereby rotation of the cam to its normal position moves the flexible web to its normal position against the drive member and whereby rotation of the cam to its releasing position allows the web to move to its releasing position away from the drive member and wherein the gate ring is formed of plastic, the web is integrally formed on the gate ring and the web is mounted such that it is elastically stretched by the cam to its normal position whereby the web is urged against the cam to limit movement of the cam, and the elasticity of the web urges it to the releasing position when the cam is not urging the web to its normal position.

5. The improvement of claim 4 further comprising gripping means on the web for contacting gripping means on the drive member for securing the drive member to the web and gate ring.

* * * * *